US005577756A

United States Patent [19]

Caron

[11] Patent Number: 5,577,756

[45] Date of Patent: Nov. 26, 1996

[54] SNOWBOARD BINDING SYSTEM

[76] Inventor: Jeffrey E. Caron, 170 Nanaquaket Rd., Tiverton, R.I. 02878

[21] Appl. No.: 94,474

[22] Filed: Jul. 19, 1993

[51] Int. Cl.[6] ..... A63C 9/084

[52] U.S. Cl. ..... 280/617; 280/633; 280/607

[58] Field of Search ..... 280/607, 617, 280/618, 633, 14.2, 614, 615, 11.26, 11.33, 615

[56] References Cited

U.S. PATENT DOCUMENTS

| | | | |
|---|---|---|---|
| 3,685,846 | 8/1972 | Schmid | 280/607 |
| 3,797,844 | 3/1974 | Smolka | 280/11.35 |
| 3,817,543 | 6/1974 | Haff | 280/607 |
| 4,002,354 | 1/1977 | Ramer | 280/614 |
| 4,804,700 | 2/1989 | Kuchler | 280/607 |
| 4,896,895 | 1/1990 | Bettosini | 280/607 |
| 5,044,656 | 9/1991 | Peyre | 280/618 |
| 5,085,455 | 2/1992 | Bergner | 280/618 |
| 5,190,311 | 3/1993 | Carpenter | 280/618 |
| 5,282,642 | 2/1994 | Provence | 280/615 |

*Primary Examiner*—Richard M. Camby
*Attorney, Agent, or Firm*—Ellen C. Childress

[57] ABSTRACT

A binding system for a snowboard is presented which allows for flexible bowing of the snowboard while reducing rotational play at the boot-binding interface. It has a toe hold and a heel hold which are slideably connected. The connection is adjustable. Further adjustment and shock absorption is provided by incrementally added spacers.

9 Claims, 3 Drawing Sheets

SNOWBOARD BINDING SYSTEM

FIELD OF THE INVENTION

This invention relates to binding systems for securing footwear to a surface such as skis and other sportboards.

BACKGROUND OF THE INVENTION

A snowboard is like a single wide ski, usually with one or more platforms supporting the feet of a skier. One such board is shown in U.S. Pat. No 5,190,311. Because snowboard riders face somewhat across the board, similar to a skateboard rider, snowboards have front and rear fixed boot bindings which allow a rider to place a foot angled across the longitundinal axis (a line connecting the front and rear ends of the board) of the board, in contrast to conventional skis.

Skis and snowboards, used on uneven runs, or during stresses such as turning and stopping tend to flex. When a rigid platform is mounted onto the ski or snowboard, flexing is restrained in that part of the board, stressing the board unevenly and interfering with control and ride of the rider. The upward flex of skis is noted and an approach to the problem suggested by U.S. Pat. No. 3,797,844. Here, a rigid plate is spaced from the ski and mounted on two mounts having pivot pins. One pivot pin rests in a slotted hole.

U.S. Pat. Nos. 5,085,455 and 5,044,656, incorporated herein by reference, disclose plate type bindings adapted with safety releases.

During certain maneuvers, and on rough terrain, portions of the board, or the whole board are lifted from contact with the snow momentarily and when the board falls back to the snow the rider is bumped about. These bumps range vibrational to jolting and can distract the rider, or over a period of time, cause injury to the rider. One shock absorber, for skis, is described in U.S. Pat. No. 4,896,895, incorporated herein by reference.

There exists a need for a snowboard binding which allows maximum flexure of the snowboard and damps transmitted impacts.

SUMMARY OF THE INVENTION

This binding is adjustable in a continuous way to fit all of ski and snowboard boots which have soles for "plate" type mounting. The binding allows the user to freely adjust their stance, and can be mounted at any angle with respect to the longitudinal axis of the board. A damping system is created by the spring action of the mount itself and an adjustable damping system which also allows the toe or heel of the boot to be incrementally elevated and canted (angling of the boot with respect to the boots horizontal axis) and further prevents rotational motion about the axis connecting the heel and toe of the boot and an axis connecting the sides of the foot.

This binding system will not separate from the snowboard under normal operating conditions; accommodates variations in forces during snowboarding, thus allowing the board to flex underfoot; and is simple to construct and lightweight. The binding system absorbs and damps vibrations riding.

The snowboard binding system holds the boot rigidly to the board by a retention bar in the toe area which flexes upward to accommodate the boot and consequently produces a springed tension which allows minimal rotational play between the boot and binding, such that less space is created between the base of the boot and the binding is less than in presently available systems when the rider leans.

Rotational play can result in losing control of the board while riding. The toe section includes a platform which can slide, allowing the board to flex freely under foot. To absorb and dampen vibration and to provide a flexible system of controlling boot pitch, a system of laminated inserts is used.

DETAILED DESCRIPTION OF THE INVENTION

Figure 1:
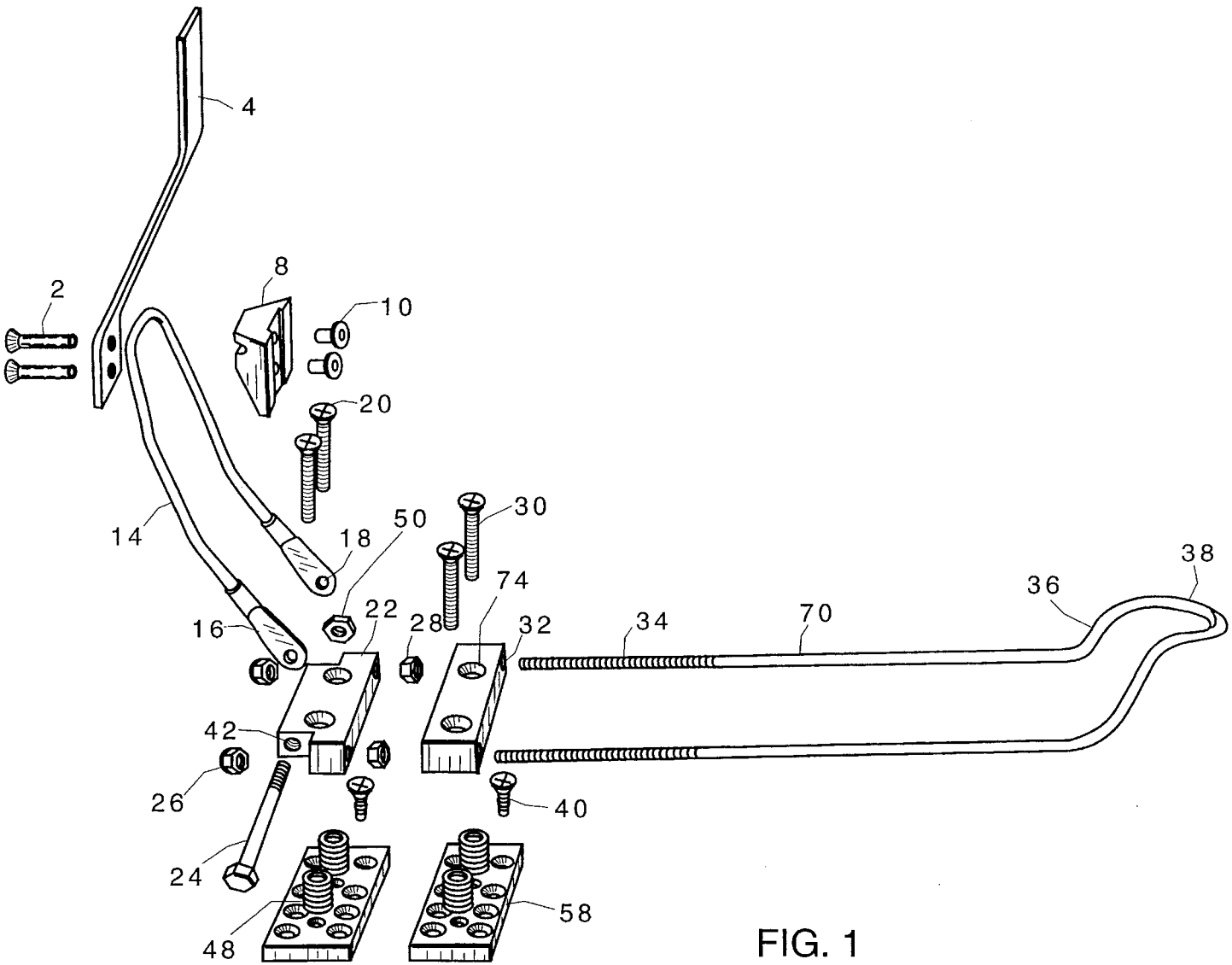
FIG. 1 is an exploded view of a binding system according to the invention.
Figure 2A:
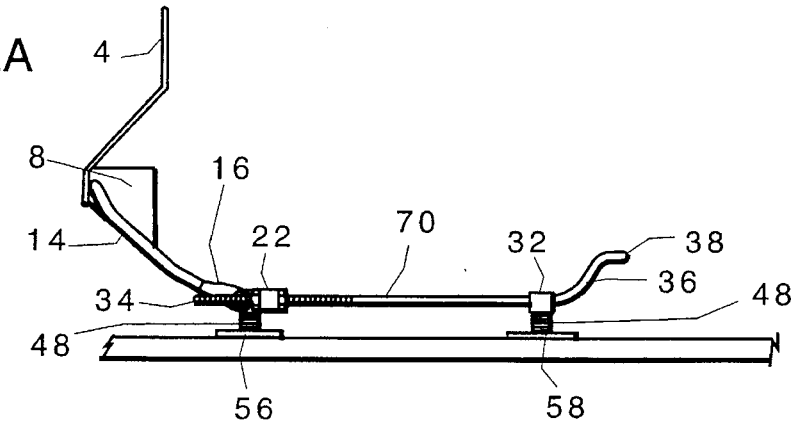
FIGS. 2A through 2D are side view of the binding during attachment and use.
Figure 2B:
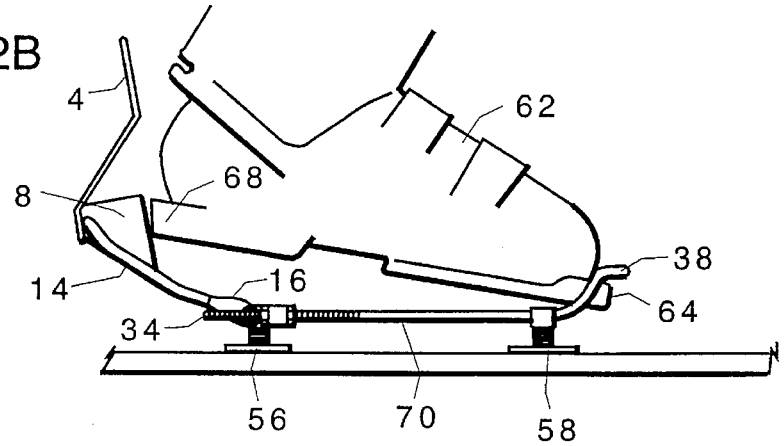
Figure 2C:
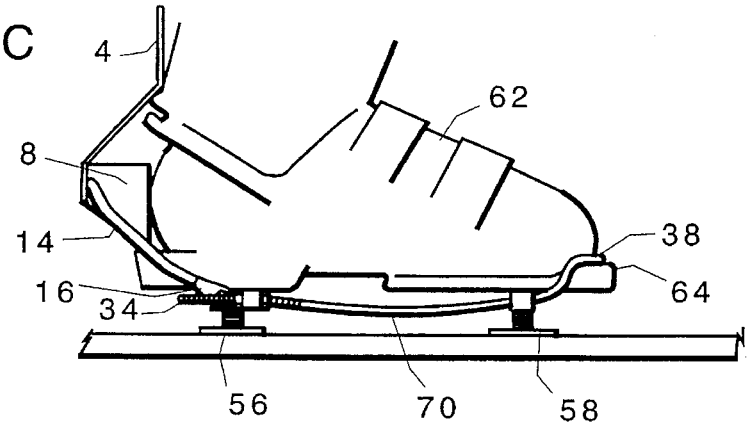
Figure 2D:
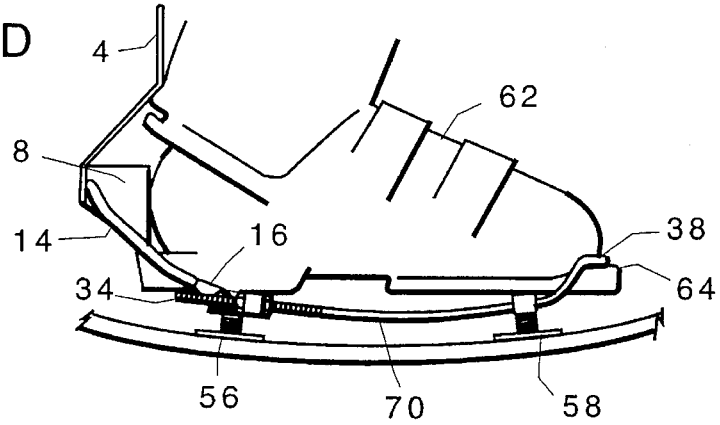

As shown in FIGS. 1 and 2, the upper raised portion of a U-shaped bolt forms a downward toe hold (38). A inclined portion of the bolt (36), allows the toe hold (38) to rest on the upper surface of the front sole edge (64) of a ski or snowboard boot (62). The bolt has a straight area (70) which terminates on each side with threads (34). The bolt first passes through openings in the side of a toe block (32), first adjustment lockdown nuts (28), heel block (22) and then through second adjustment lockdown nuts (26). The toe block (32) is free to move along the straight area (70) of the U-bolt. The lockdown nuts (26, 28) abut the openings in the heel block (22). The toe block (32) is mounted to the board by means of a threaded fastener (30) and apertures (74). It is desirable to mount the toe block (32) indirectly, that is on a mounting plate (58) which is directly fastened to the board by threaded fastener (40). To incline or cant the boot properly, incremental spacers (48) such as laminated washers called bonded sealing washers are placed between the toe block and the mounting plate (58). Other spacers such as metal washers or urethane compression springs can be used. Laminated washers provide canting and vibration damping at a reasonable price.

The heel block (22) is similarly mounted with threaded fasteners (20) and a rear mounting block (56). The T shape of the heel block (22) allows the fastening of a bail type locking system for engaging the heel (68) of a boot (62). A handle (4) is connected to the upper portion of a U-shaped bail (14), by means of fasteners (2) which engage a rubber or plastic heel lock down block (8) and securing nuts (10). The lower portion (16) of the bail (14) has apertures (18) which are placed on wither side of the stem portion of the T-shaped heel block (22). A bolt (24) passes through a first bail aperture (18), then through a transverse channel (42) in the heel block (22), then through a second bail aperture (18) and is secured with a nut (50).

The wearer inserts the boot (62) into the binding by placing the toe edge of the sole (64) under the raised section (38) of the U-bolt, and setting down the boot heel (68) beneath the lock block (8). The handle (4) is pressed toward the boot (62) locking the boot (62) into position.

Prior to inserting the boots, lock down nuts (26, 28) can be moved along the threaded portion (34) of the U-bolt to adjust the binding to properly fit the boot (62). When properly adjusted, the straight portion (70) of the U-bolt is slightly bowed (FIGS. 2C and 2D) forming a torsion spring which securely holds the boot and prevents rotational play. During use, because of the unique sliding toe hold (32), the board is free to flex smoothly.

Although the above described embodiment has a fixed heel section and a slideable toe section, the toe can be fixed and the heel slideable. Likewise the pivotal bail and block assembly can be engaged to the toe instead of the heel.

Figure 3:
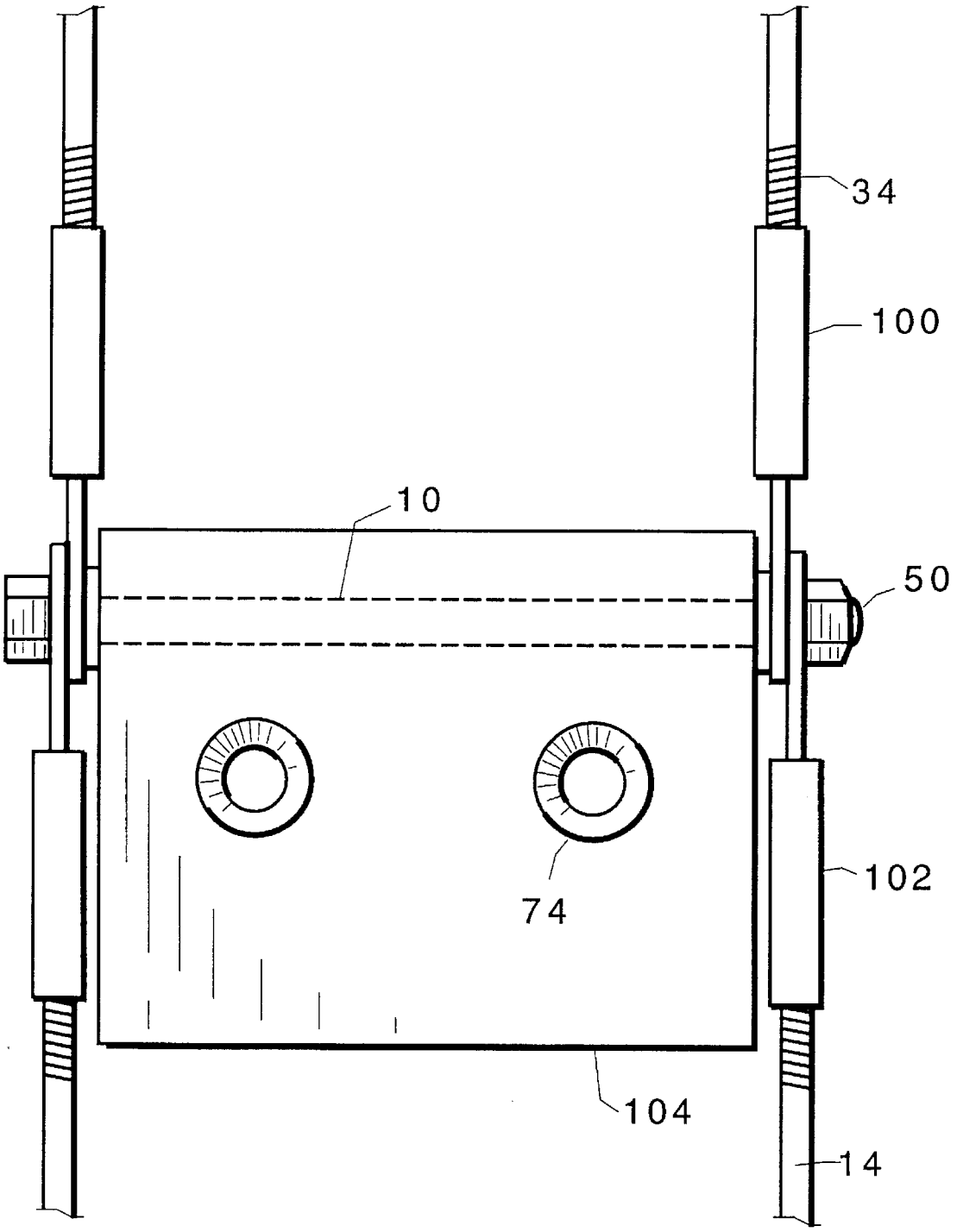
FIG. 3 is a top partial view of an alternate embodiment.

As seen in FIG. 3, threads (34) on and width of the U-shaped member can be reduced and used with a rectangular block (104), by using two pairs of threaded eye nuts (100 and 102), while still maintaining a continuous adjustability. This decreases complexity of manufacturing (less threading and less machining) and lessens weight of the finished binding.

Suitable materials for construction of the binding include: cast or machined metals such as aluminum, titanium, or steel for the following parts—toe and heel blocks, mounting plates, handles, U-bolts, threaded fasteners, and bail; natural and synthetic polymers such as natural rubber, nylon, acrylics, high molecular weight polyethylenes, or polymers available under the trade name DELRIN, and composites including ceramic and graphite (carbon) composites are suitable for machined or molded parts such as the lock block. If reinforced plastics prove sufficiently durable, polymers could be used to replace unthreaded metal components. For spacers, suitable materials are metal washers, compressible polymers, and laminates made from metals and polymers.

The components of the binding act together to form a simple, adjustable, binding which damps vibration, securely binds the boot to a board and allows free flexing of the snowboard.

What is claimed is:

1. A binding comprising:

means for engaging a first end of a boot;

means for engaging a second end of said boot; and means for slideably connecting said first end engaging means and said second end engaging means, wherein said first end engagement means further comprises:

a U-shaped member; and said slidable connection further comprises: a block having a bore, and wherein said U-shaped member is angled to engage the edge of a boot bottom, wherein said second end engagement means further comprises:

a lock down means;

a bail for actuating said lock down means;

and a second block having a bore, such that, when said boot is engaged, said U-shaped member forms a spring further comprising:

first and second mounting plates for connecting said first and second end engagement means to said board said binding further comprising:

canting means located between said engagement means and said mounting plates.

2. The binding of claim 1 wherein said canting means further comprises:

laminated spacers.

3. The binding of claim 1 wherein said spacers are washers.

4. A binding comprising:

means for engaging a first end of a boot;

means for engaging a second end of said boot; and means for slideably connecting said first end engaging means and said second end engaging means, wherein said first end engagement means further comprises:

a U-shaped member; and said slideable connection further comprises:

a block having a bore, and wherein said U-shaped member is angled to engage the edge of a boot bottom, wherein said second end engagement means further comprises:

a lock down means;

a bail for actuating said lock down means; and a second block having a bore, such that, when said boot is engaged, said U-shaped member forms a sping;

wherein said binding further comprises:

means for adjusting said slideable connection.

5. A binding comprising:

means for engaging a first end of a boot;

means for engaging a second end of said boot; and means for slideably connecting said first end engaging means and said second end engaging means, wherein said first end engagement means further comprises:

a U-shaped member; and said slidable connection further comprises:

a block having a bore, and wherein said U-shaped member is angled to engage the edge of a boot bottom, wherein said second end engagement means further comprises:

a lock down means;

a bail for actuating said lock down means;

and a second block having a bore, such that, when said boot is engaged, said U-shaped member forms a spring;

said binding further comprising:

means for adjusting said slidable connection, wherein said adjustment means further comprises:

threads located on said slidable connection, wherein said binding further comprises:

canting means located between said engagement means and said mounting plates.

6. A binding comprising:

means for engaging a first end section of a boot sole, said means comprising a U-shaped bar wherein the arms of the U are bent from the plane of the rounded section of the U;

arm receiving means securable to a board, receiving the arms of said U shaped bar; and means for preventing rotation of said U-shaped bar.

7. The binding of claim 6 further comprising:

means for engaging a second end section of said boot sole; and means for adjusting the distance between said arm receiving means and said rounded section of said U shaped bar, such that when a boot sole is engaged between said means for engaging said first end section and said means for engaging said second end section of said boot sole, that tightening said adjustment means exerts a downward force on said first end section of said boot sole.

8. The binding of claim 7 wherein said means for adjusting is located on the arms of said U.

9. The binding of claim 8 wherein said downward force spring loads said binding.

* * * * *